United States Patent [19]

Watanabe

[11] Patent Number: 4,634,260

[45] Date of Patent: Jan. 6, 1987

[54] IMAGE FORMING APPARATUS

[75] Inventor: Junji Watanabe, Yokohama, Japan

[73] Assignee: Kabushiki Kaisha Toshiba, Kawasaki, Japan

[21] Appl. No.: 770,789

[22] Filed: Aug. 29, 1985

[30] Foreign Application Priority Data

Sep. 3, 1984 [JP] Japan ..... 59-184113

[51] Int. Cl.[4] ..... G03G 15/00

[52] U.S. Cl. ..... 355/7; 355/14 E

[58] Field of Search ..... 355/3 R, 1, 7, 14 R, 355/14 E, 75

[56] References Cited

U.S. PATENT DOCUMENTS

| | | | |
|---|---|---|---|
| 4,008,954 | 2/1977 | Ogawa et al. | 355/3 R X |
| 4,215,929 | 8/1980 | Sato | 355/7 |
| 4,255,042 | 3/1981 | Armitage, Jr. et al. | 355/1 X |
| 4,256,400 | 3/1981 | Komori | 355/14 SH |
| 4,487,498 | 12/1984 | Guderley | 355/14 R |

FOREIGN PATENT DOCUMENTS

| | | | |
|---|---|---|---|
| 3020687 | 12/1980 | Fed. Rep. of Germany : | |
| 59-15948 | 1/1984 | Japan | 355/7 |

OTHER PUBLICATIONS

Research Disclosure, vol. 227, Mar. 1983, pp. 116–118, Havant, Hampshire, Great Britain, "Copying Machine", whole document.

Patent Abstracts of Japan, vol. 6, No. 8, Jan. 19, 1982, JP-A-56 133 753 (Canon K.K.) 20-10-1983, Abstract.

*Primary Examiner*—Arthur T. Grimley

*Assistant Examiner*—J. Pendegrass

*Attorney, Agent, or Firm*—Cushman, Darby & Cushman

[57] ABSTRACT

An image forming apparatus is provided with a light emitting element for indicating a specific range of an original disposed on an original table, and the other light emitting elements for erasing the electric charge on the surface of a photosensitive body in response to the specific range of the original indicated by the light emitting element. A spot light is applied to the original on the original table by the light emitting element, and moved to specify an erasure range. In image forming, a light beam is applied to a photosensitive body in response to the specified erasure range to erase an electrostatic latent image or electric charge thereon by the other light emitting elements.

9 Claims, 19 Drawing Figures

IMAGE FORMING APPARATUS

BACKGROUND OF THE INVENTION

The present invention relates to an image forming apparatus applied to an electronic copying machine, and more specifically to an image forming apparatus which comprises a photosensitive body holding electric charge, charging means for applying electric charge to the photosensitive body, exposure means for optically scanning an image of an original and exposing the photosensitive body charged by the charging means, thereby forming an electric charge pattern responsive to the original image, and developing means for developing the electric charge pattern formed on the photosensitive body by the exposure means.

In general, electronic copying machines copy an image of the original on to a paper sheet directly or on an enlarged or reduced scale.

Meanwhile, some of the contents of the original may be omitted as unnecessary in copying. In copying, however, conventional copying machines cannot selectively erase the unnecessary portions of the original image.

SUMMARY OF THE INVENTION

The present invention is contrived in consideration of these circumstances, and is intended to provide an image forming apparatus capable of forming an image of the original while erasing any designated portions of the image.

According to the present invention, a spot light is applied to the original image by indicating means, and moved to specify an erasure range. In image forming, a light beam is applied to a photosensitive drum in response to the specified erasure range to erase an electrostatic latent image or electric charge thereon by erasing means.

BRIEF DESCRIPTION OF THE DRAWINGS

FIGS. 1 to 18 show an embodiment of an image forming apparatus according to the present invention, in which:

FIGS. 1 and 2 are a schematic perspective view and a side sectional view, respectively, showing the construction of the image forming apparatus;

FIG. 3 is a plan view of a control panel;

FIG. 4 is a perspective view showing an arrangement of drive sections;

FIG. 5 is a perspective view schematically showing a drive mechanism for an optical system;

FIG. 6 is a perspective view schematically showing a drive mechanism for indexes;

FIG. 7 is a block diagram showing a general control circuit;

FIG. 8 is a perspective view of the principal part including a spot light source;

FIG. 9 is a side sectional view of the principal part including the spot light source;

FIGS. 10, 11 and 12 are plan views illustrating an operation for specifying the erasure range of the original using the spot light source;

FIG. 13 is a side sectional view of the principal part showing an arrangement of the erasure array;

FIGS. 14 and 15 are a perspective view and a front view, respectively, of only the principal part of the erasure array, showing the relationship between the erasure array and a photosensitive drum;

FIG. 17 is a circuit diagram illustrating the configuration of an array drive section; and FIG. 18 is a side sectional view of the principal part showing another arrangement of the erasure array.

DETAILED DESCRIPTION OF THE PREFERRED EMBODIMENT

One embodiment of the present invention will now be described in detail with reference to the accompanying drawings.

Figure 1:
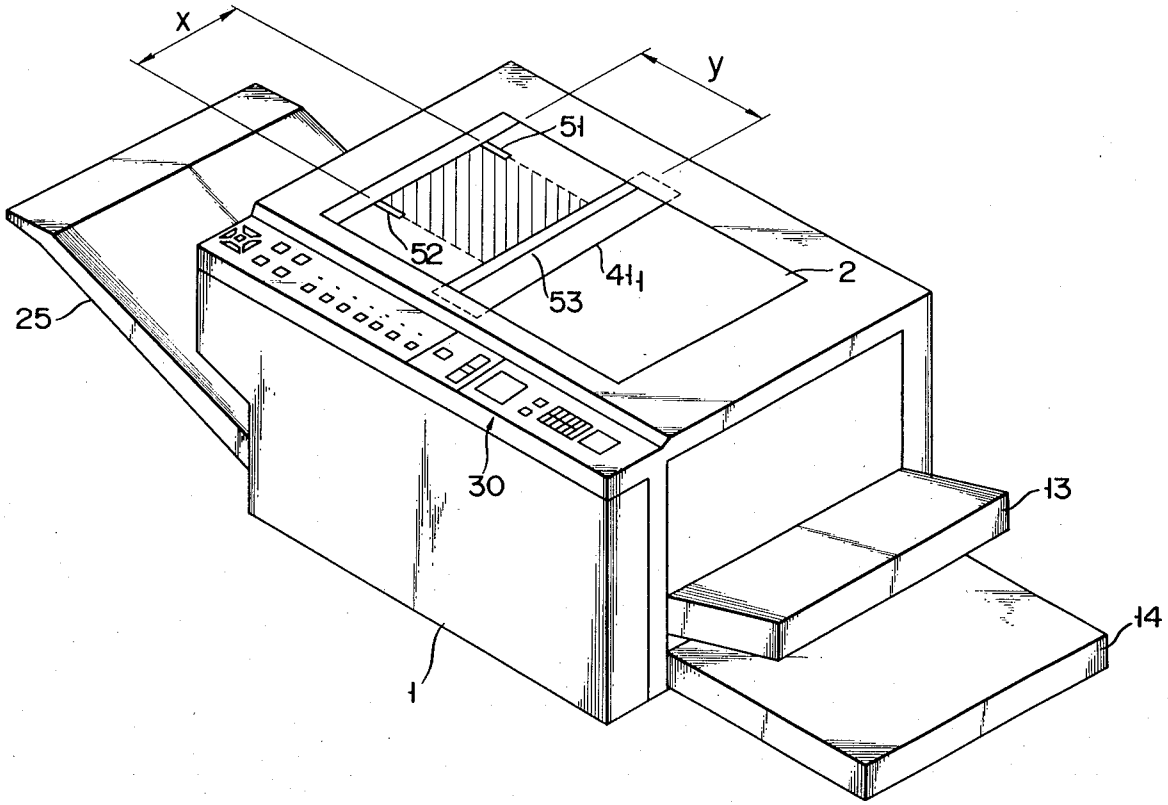
Figure 2:
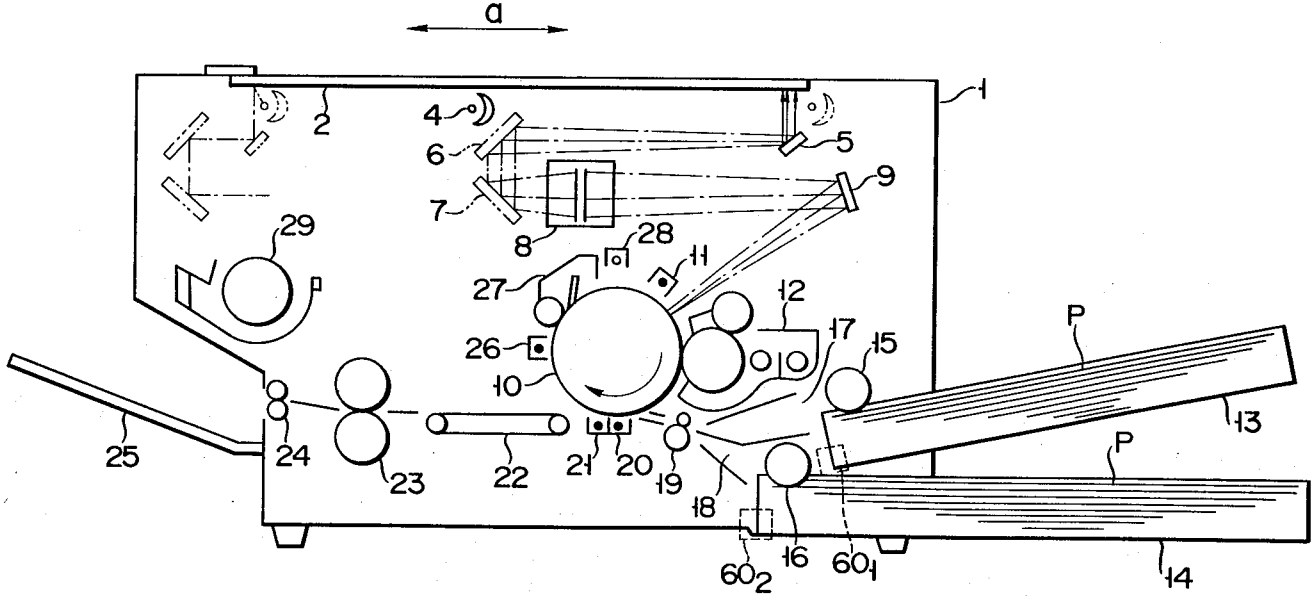

FIGS. 1 and 2 schematically show a copying machine as an image forming apparatus according to the embodiment of the invention. In FIGS. 1 and 2, numeral 1 designates a housing of the copying machine. An original table 2 (transparent glass) for carrying an original is fixed on the top of the housing 1 (original cover is not shown). The original set on the original table 2 is scanned for image exposure as an optical system 3 including an exposure lamp 4 and mirrors 5, 6 and 7 reciprocates in the direction indicated by arrow a along the under surface of the original table 2. In this case, the mirrors 6 and 7 move at a speed half that of the mirror 5 so as to maintain a fixed optical path length.

A reflected light beam from the original scanned by the optical system 3, that is, irradiated by the exposure lamp 4, is reflected by the mirrors 5, 6 and 7, transmitted through a lens block 8 for magnification or reduction, and then reflected by a mirror 9 to be projected on a photosensitive drum 10. Thus, an image of the original is formed on the surface of the photosensitive drum 10.

The photosensitive drum 10 rotates in the direction indicated by arrow c so that its surface is wholly charged first by a main charger 11. The image of the original is projected on the charged surface of the photosensitive drum 10 by slit exposure, forming an electrostatic latent image on the surface. The electrostatic latent image is developed into a visible image (toner image) by a developing unit 12 using toner. Paper sheets (image record media) P are delivered one by one from an upper paper cassette 13 or a lower paper cassette 14 by a paper-supply roller 15 or 16, and guided along a paper guide path 17 or 18 to an aligning roller pair 19. Then, each paper sheet P is delivered to a transfer region by the aligning roller pair 19, timed to the formation of the visible image.

The two paper cassettes 13 and 14 are removably attached to the lower right end portion of the housing 1, and can be alternatively selected by operation on a control panel which will be described in detail later. The paper cassettes 13 and 14 are provided respectively with cassette size detecting switches $60_1$ and $60_2$ which detect the selected cassette size. The detecting switches $60_1$ and $60_2$ are each formed of a plurality of microswitches which are turned on or off in response to insertion of cassettes of different sizes.

The paper sheet P delivered to the transfer region comes into intimate contact with the surface of the photosensitive drum 10, in the space between a transfer charger 20 and the drum 10. As a result, the toner image on the photosensitive drum 10 is transferred to the paper sheet P by the agency of the charger 20. After the transfer, the paper sheet P is separated from the photosensitive drum 10 by a separation charger 21 and transported by a conveyor belt 22. Thus, the paper sheet P is delivered to a fixing roller pair 23 as a fixing unit arranged at the terminal end portion of the conveyor belt 22. As the paper sheet P passes through the fixing roller pair 23, the transferred image is fixed on the sheet P. After the fixation, the paper sheet P is discharged into a tray 25 outside the housing 1 by an exit roller pair 24.

After the transfer, moreover, the photosensitive drum 10 is de-electrified by a de-electrification charger 26, when the residual toner on the surface of the drum 10 is removed by a cleaner 27. Thereafter, a residual image on the photosensitive drum 10 is erased by a discharge lamp 28 to restore the initial state. In FIG. 2, numeral 29 designates a cooling fan for preventing the temperature inside the housing 1 from rising.

Figure 3:
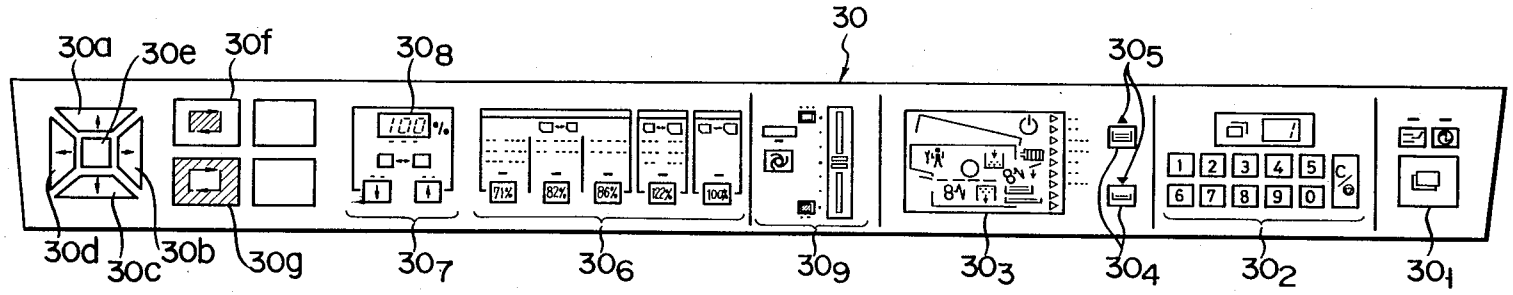

FIG. 3 shows a control panel 30 mounted on the housing 1. The control panel 30 carries thereon a copy key $30_1$ for starting the copying operation, ten-keys $30_2$ for setting the number of copies to be made and the like, a display section $30_3$ for indicating the operating conditions of the individual parts or paper jamming, cassette selection keys $30_4$ for alternatively selecting the upper or lower paper cassette 13 or 14, and cassette display sections $30_5$ for indicating the selected cassette. The control panel 30 is further provided with ratio setting keys $30_6$ for setting the enlargement or reduction ratio of copy selected among several predetermined ratios, zoom keys $30_7$ for adjustably setting the enlargement or reduction ratio, a display section $30_8$ for displaying the set ratio, and a density setting section $30_9$ for setting the copy density. Additionally arranged on the control panel 30 are operation keys 30*a*, 30*b*, 30*c* and 30*d* for shifting a spot light source (mentioned later) which serves to indicate erasure positions on the original, a position designating key 30*e* for inputting the coordinate positions indicated by the spot light source, and erasure range designating keys 30*f* and 30*g* for designating the erasure ranges in the designated positions.

Figure 4:
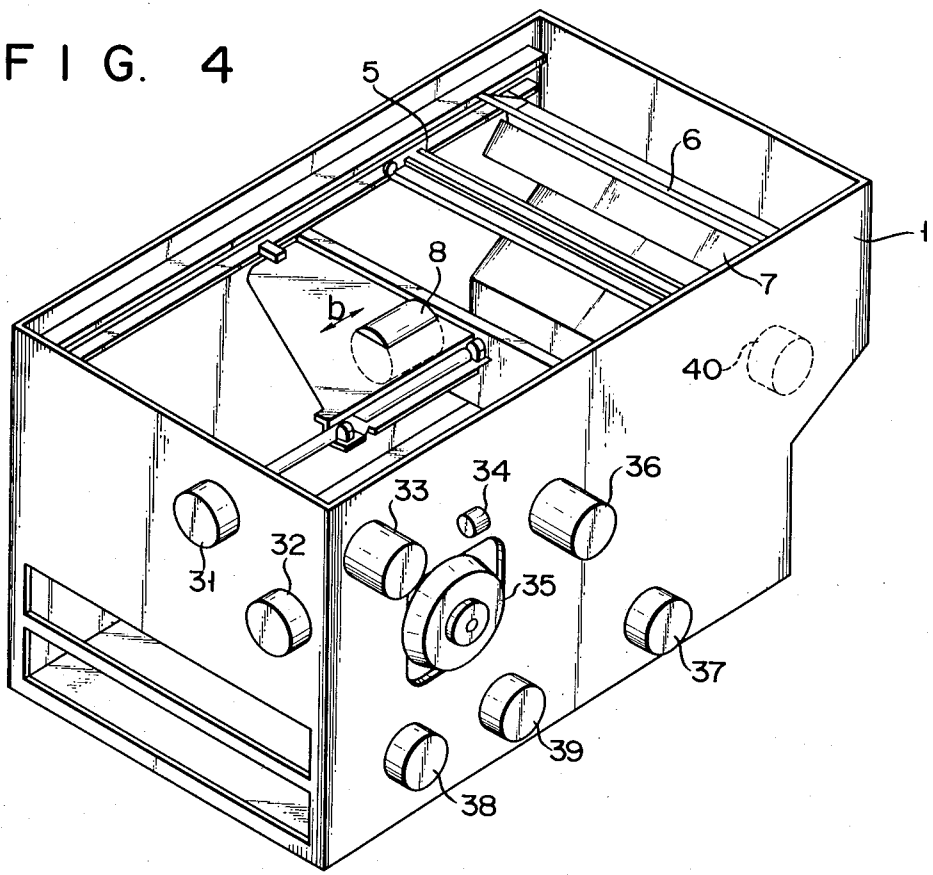

FIG. 4 shows a specific arrangement of drive sources for individual drive sections of the copying machine constructed in the aforesaid manner. The drive sources include the following motors. Numeral 31 designates a motor for lens drive. The lens drive motor 31 serves to shift the position of the lens block 8 for magnification or reduction. Numeral 32 designates a motor for mirror drive. The mirror drive motor 32 serves to change the distance (optical path length) between the mirror 5 and the mirrors 6 and 7 for magnification or reduction. Numeral 33 designates a motor for scanning. The scanning motor 33 serves to move the exposure lamp 4 and the motors 5, 6 and 7 for scanning the original. Numeral 34 designates a motor for shutter drive. The shutter drive motor 34 serves to move a shutter (not shown) for adjusting the width of charging of the photosensitive drum 10 by the charger 11 at the time of magnification or reduction.

Numeral 35 designates a motor used for developing. The developing motor 35 serves to drive the developing roller and the like of the developing unit 12. Numeral 36 designates a motor used to drive the drum. The drum drive motor 36 serves to drive the photosensitive drum 10. Numeral 37 designates a motor for fixation. The fixing motor 37 serves to drive the sheet conveyor belt 22, the fixing roller pair 23, and the exit roller pair 24. Numeral 38 designates a motor for paper supply. The paper supply motor 38 serves to drive the paper-supply rollers 15 and 16. Numeral 39 designates a motor for feeding sheets. The sheet feed motor 39 serves to drive the aligning roller pair 19. Numeral 40 designates a motor for fan drive. The fan drive motor 40 serves to drive the cooling fan 29.

Figure 5:
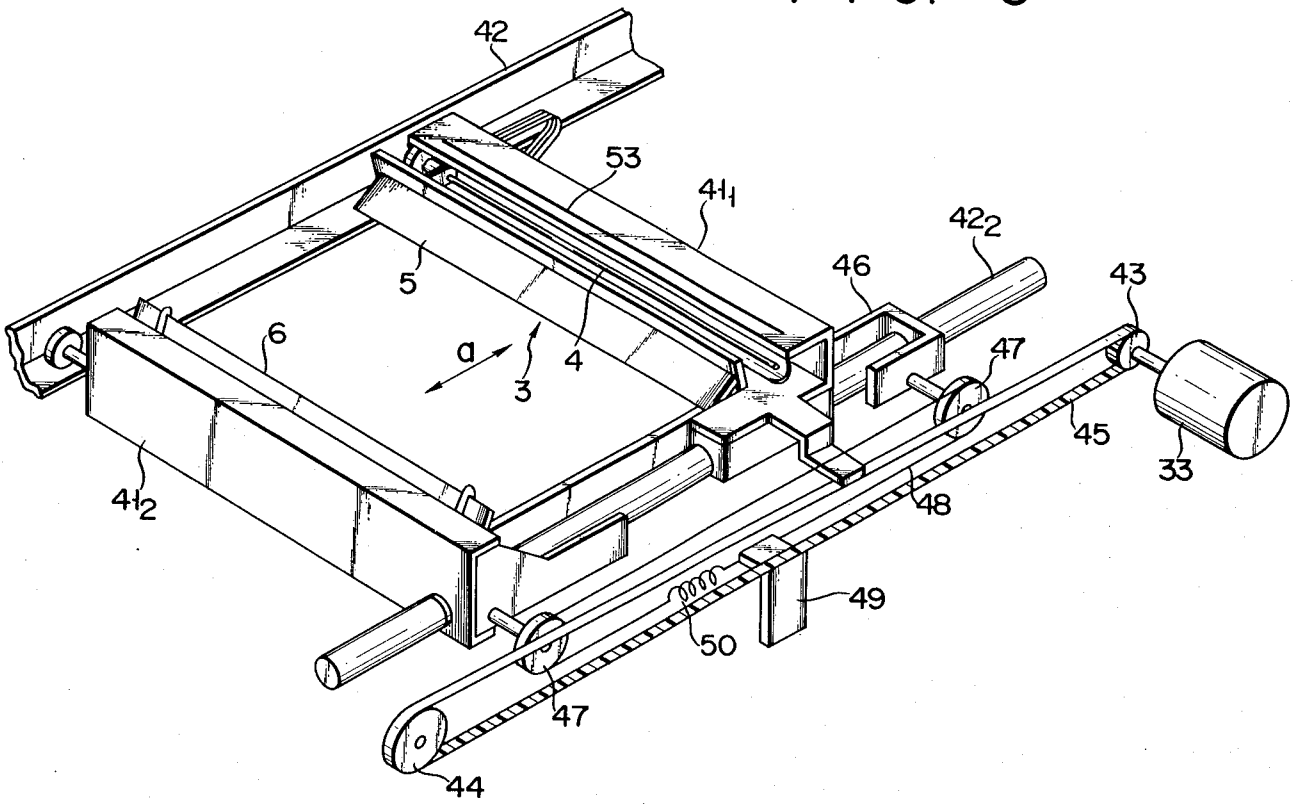

FIG. 5 shows a drive mechanism for reciprocating the optical system 3. The mirror 5 and the exposure lamp 4 are supported by a first carriage $41_1$, and the mirrors 6 and 7 by a second carriage $41_2$. These carriages $41_1$ and $41_2$ can move parallel in the direction indicated by arrow a, guided by guide rails $42_1$ and $42_2$. The four-phase pulse motor 33 drives a pulley 43. An endless belt 45 is stretched between the pulley 43 and an idle pulley 44, and one end of the first carriage $41_1$ supporting the mirror 5 is fixed to the middle portion of the belt 45.

On the other hand, two pulleys 47 are rotatably attached to a guide portion 46 (for the rail $42_2$) of the second carriage $41_2$ supporting the mirrors 6 and 7, spaced in the axial direction of the rail $42_2$. A wire 48 is stretched between the two pulleys 47. One end of the wire 48 is connected directly to a fixed portion 49, while the other end is connected thereto by means of a coil spring 50. The one end of the first carriage $41_1$ is fixed to the middle portion of the wire 48.

With this arrangement, when the pulse motor 33 is driven, the belt 45 turns around to move the first carriage $41_1$. As the first carriage $41_1$ travels, the second carriage $41_2$ also travels. Since the pulleys 47 then serve as movable pulleys, the second carriage $41_2$ travels in the same direction as and at a speed half that of the first carriage $41_1$. The traveling direction of the first and second carriages $41_1$ and $41_2$ is controlled by changing the rotating direction of the pulse motor 33.

The original table 2 carries thereon an indication of a reproducible range corresponding to the size of designated paper sheets. If the sheet size designated by the sheet selection keys $30_4$ and the copy ratio specified by the ratio setting keys $30_6$ or $30_7$ are (Px, Py) and K, respectively, the reproducible range (x, y) is given by $$x = Px/K,$$
$$y = Py/K.$$

Out of the coordinates (x, y) designating any point within the reproducible range, as shown in FIG. 1, the x coordinate is indicated by indexes 51 and 52 arranged on the inside of the original table 2, and the y coordinate by a scale 53 provided on the top face portion of the first carriage $41_1$.

Figure 6:
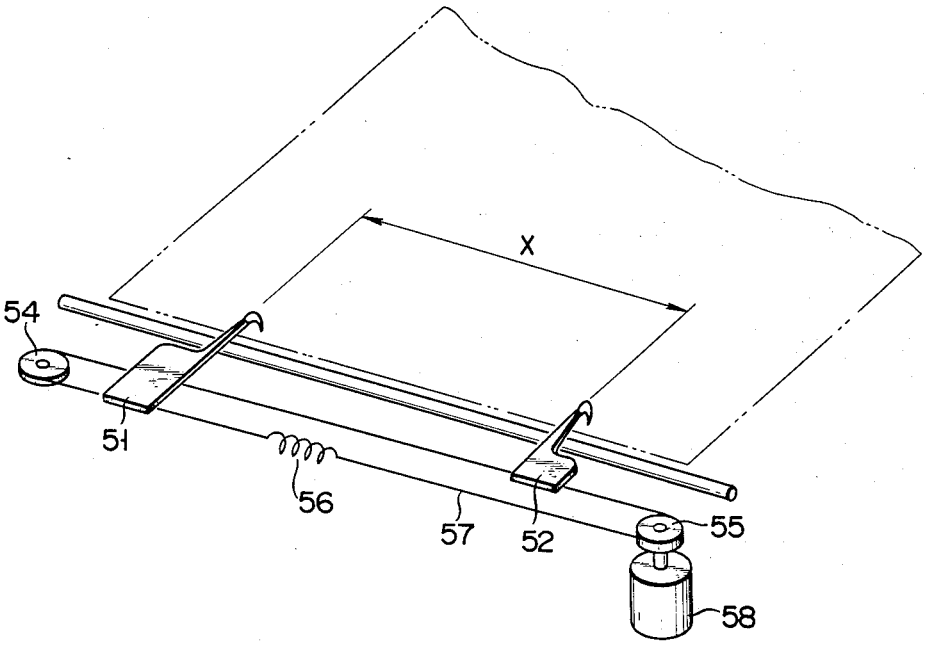

As shown in FIG. 6, the indexes 51 and 52 are attached to a wire 57 which is stretched between pulleys 54 and 55 through the aid of a spring 56. The pulley 55 is rotated by a motor 58. The distance between the indexes 51 and 52 can be changed by driving the motor 58 in accordance with the sheet size and the enlargement or reduction ratio.

The first carriage 41 moves to a predetermined position (home position depending on the enlargement or reduction ratio) as the motor 33 is driven in accordance with the sheet size and the ratio. When the copy key $30_1$ is depressed, the first carriage $41_1$ is first moved toward the second carriage $41_2$. The, the lamp 4 is lighted and the first carriage $41_1$ is moved away from the second carriage $41_2$. When the original scanning ends, the lamp 4 is turned off, and the first carriage $41_1$ is returned to the home position.

Figure 7:
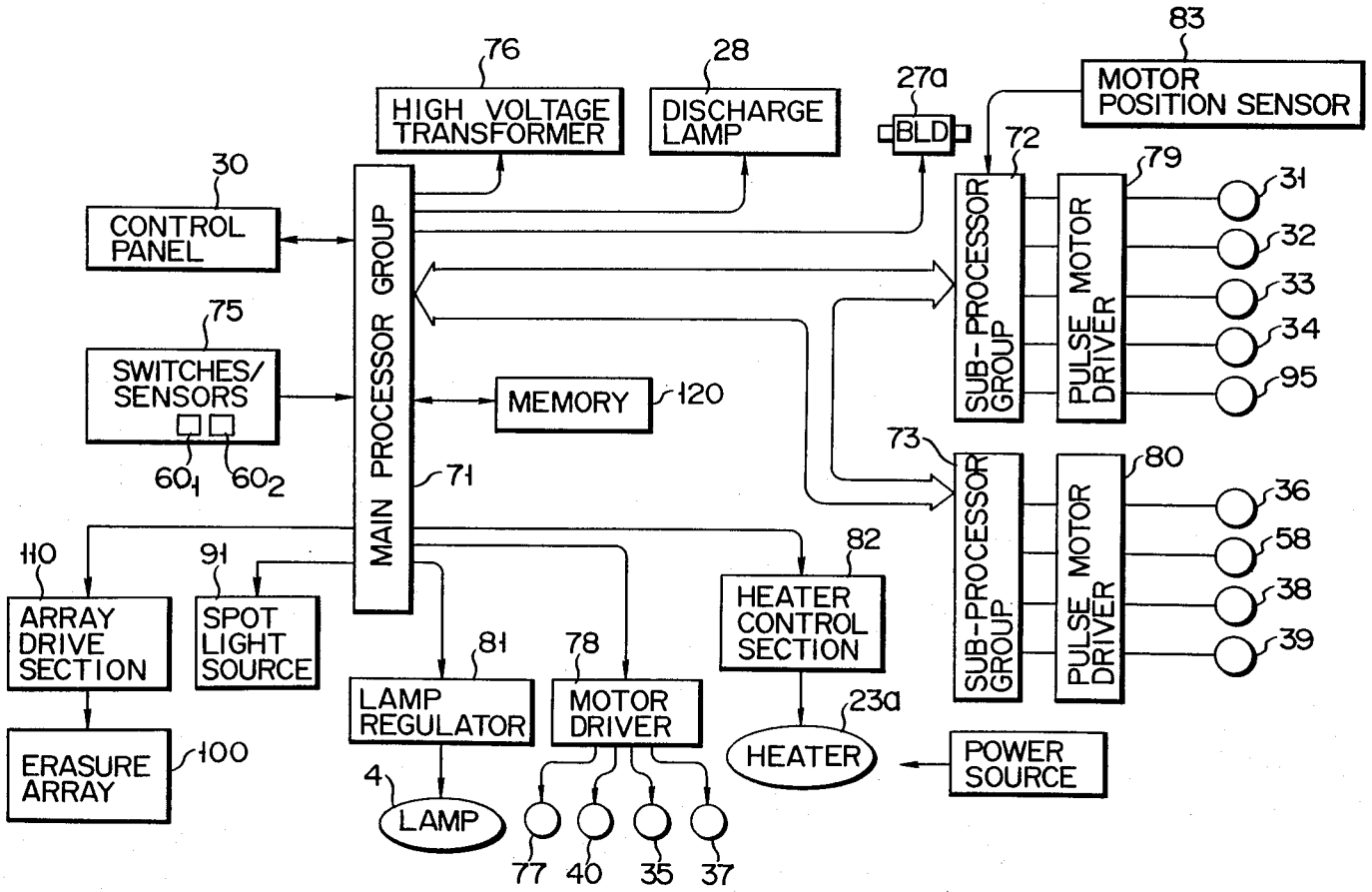

FIG. 7 shows a general control circuit of the electronic copying machine. This control circuit is mainly composed of a main processor group 71 and first and second sub-processor groups 72 and 73. The main processor group 71 detects input data from the control panel 30 and a group of input devices 75 including various switches and sensors, such as the cassette size detection switches $60_1$ and $60_2$, and controls a high-voltage transformer 76 for driving the chargers, the discharge lamp 28, a blade solenoid 27*a* of the cleaner 27, a heater 23*a* of the fixing roller pair 23, the exposure lamp 4, and the motors 31 to 40 and 58, thus accomplishing the copying operation. The main processor group 71 also controls a spot light source 91, a pulse motor 95, an erasure array 100, an array drive section 110, and a memory 120, thereby erasing any unnecessary portions of the original. These components 91, 95, 100, 110 and 120 will be described in detail later.

The motors 35, 37 and 40 and a toner-supply motor 77 for supplying the toner to the developing unit 12 are connected through a motor driver 78 to the main processor group 71 to be controlled thereby. The motors 31 to 34 and 95 are connected through a pulse motor driver 79 to the first sub-processor group 72 to be controlled thereby. The motors 36, 38, 39 and 58 are connected through a pulse motor driver 80 to the second sub-processor group 73 to be controlled thereby.

Further, the exposure lamp 4 is controlled by the main processor group 71 through a lamp regulator 81, and the heater 23*a* by the main processor group 71 through a heater control Section 82. The main processor group 71 gives instructions for the start or stop of the individual motors to the first and second sub-processor groups 72 and 73. Thereupon, the first and second sub-processor groups 72 and 73 feed the main processor group 17 with status signals indicative of the operation mode of the motors. Also, the first sub-processor group 72 is supplied with positional information from a position sensor 83 for detecting the respective initial positions of the motors 31 to 34.

Indicating means and erasing means according to the present invention will now be described in detail.

Figure 9:
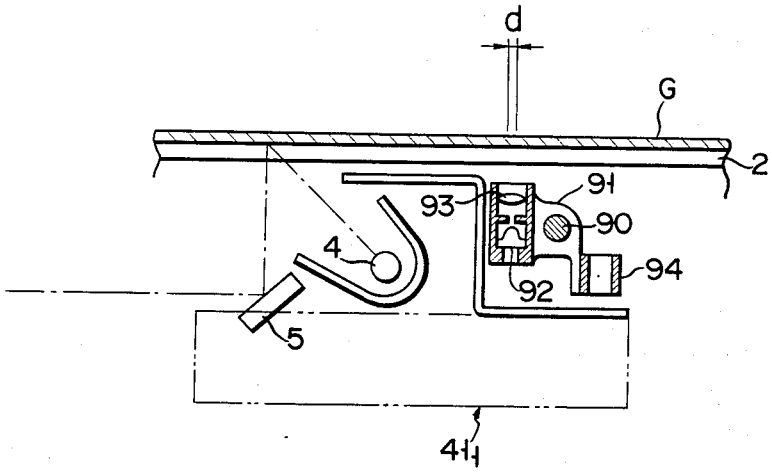
Figure 8:
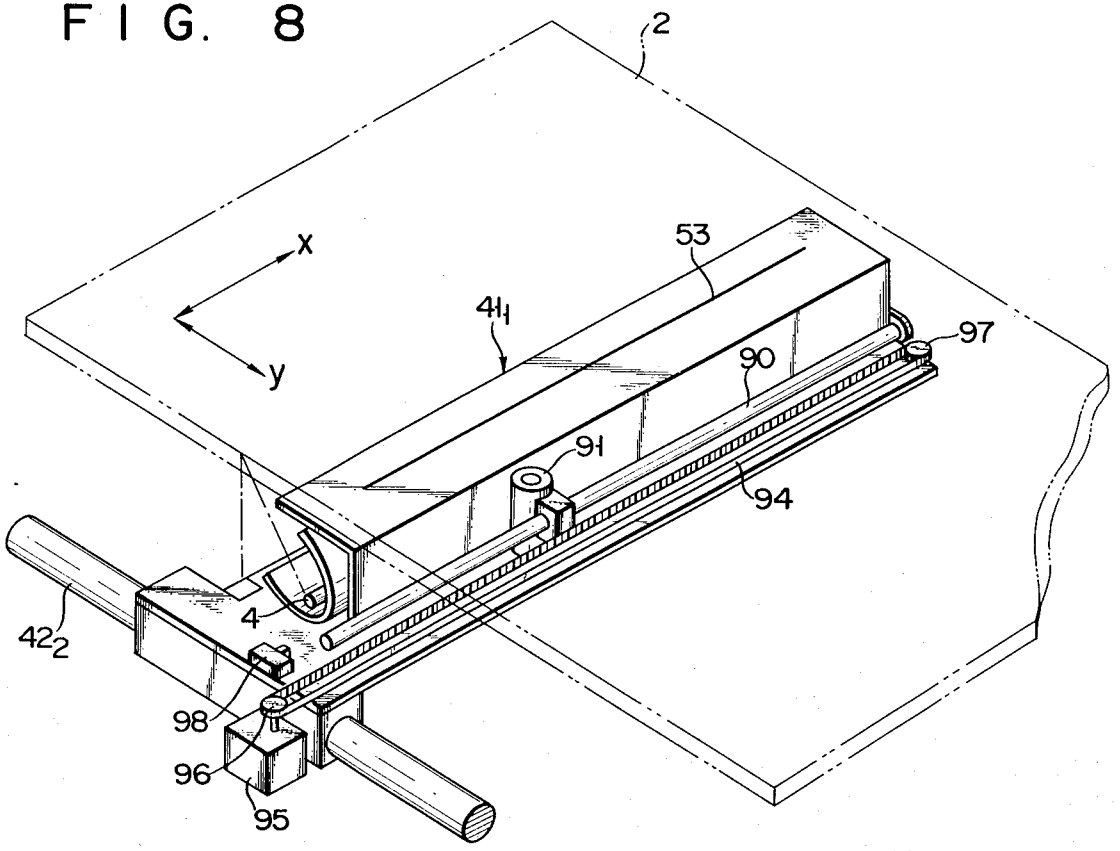

In FIGS. 8 and 9, a guide shaft 90 is disposed at that portion of the first carriage $41_1$ intercepting the light from the lamp 4, extending along the lamp 4. The guide shaft 90 is movably fitted with the spot light source 91 as the indicating means for indicating an erasure range of the original. As shown in FIG. 9, the spot light source 91 includes a light emitting element 92, such as a light emitting diode or lamp, and a lens 93 which are opposed to the original table 2.

A light beam emitted from the light emitting element 92 is applied to the original table 2 through the lens 93, as a spot light with a diameter d of, e.g., 2 mm. The spot light has enough brightness to be transmitted through an original G as thick as, e.g., a postcard set on the original table 2. The spot light source 91 is coupled to a timing belt (toothed belt) 94 extending along the guide shaft 90. The timing belt 94 is stretched between a pulley 96 mounted on the shaft of the pulse motor 95 and a driven pulley 97. As the pulse motor 95 is rotated the spot light source 91 is moved in a direction perpendicular to the scanning direction of the first carriage $41_1$.

A position sensor 98 formed of a microswitch for detecting the initial position of the spot light source 91 is attached to that portion of the first carriage $41_1$ which is located beside the end portion of the guide shaft 90 on the side of the pulse motor 95. When the spot light source 91 is moved, for example, it first abuts against the position sensor 94 to have its initial position detected thereby.

Figure 10:
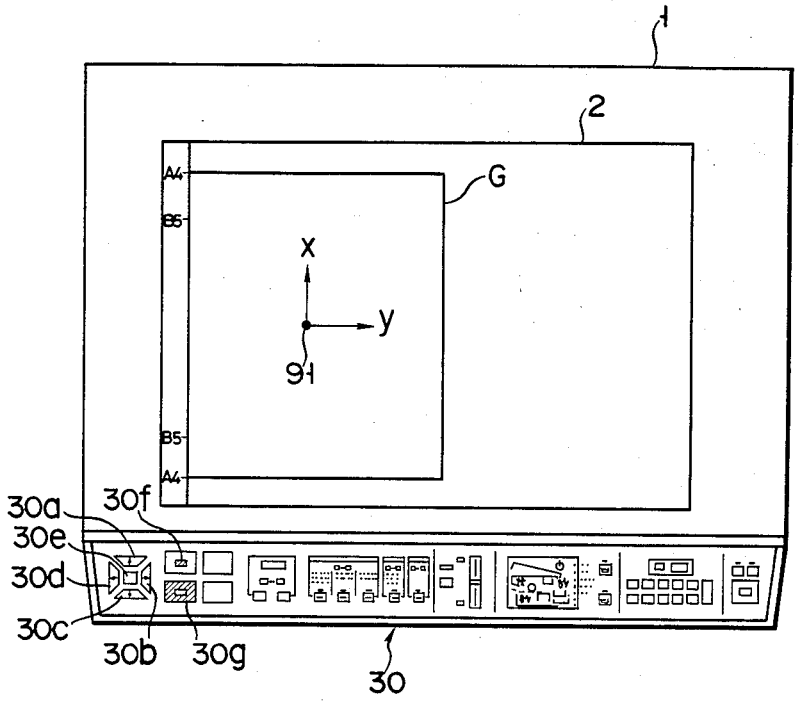
Figure 11:
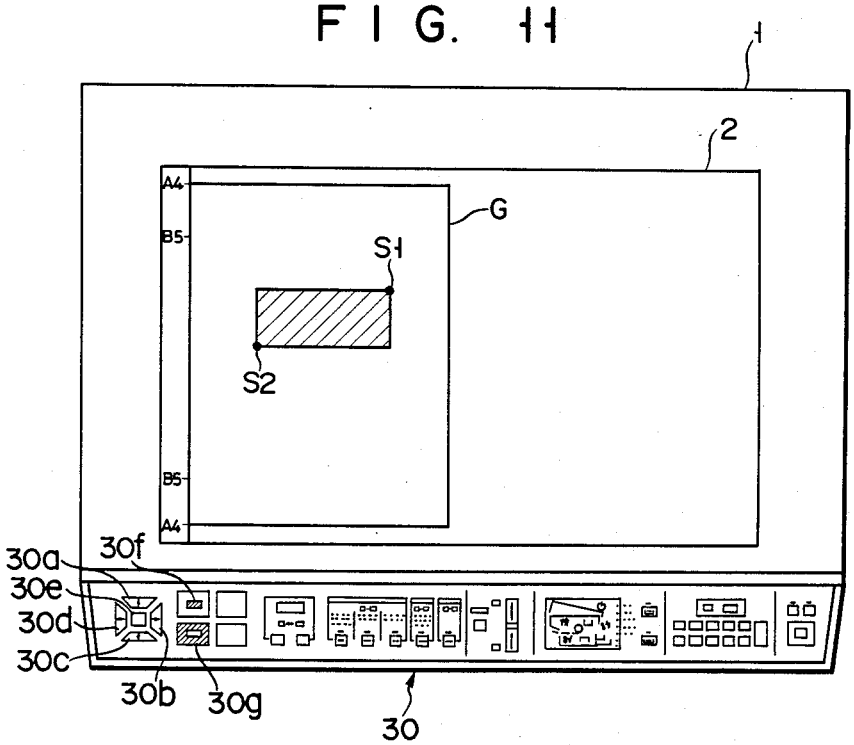
Figure 12:
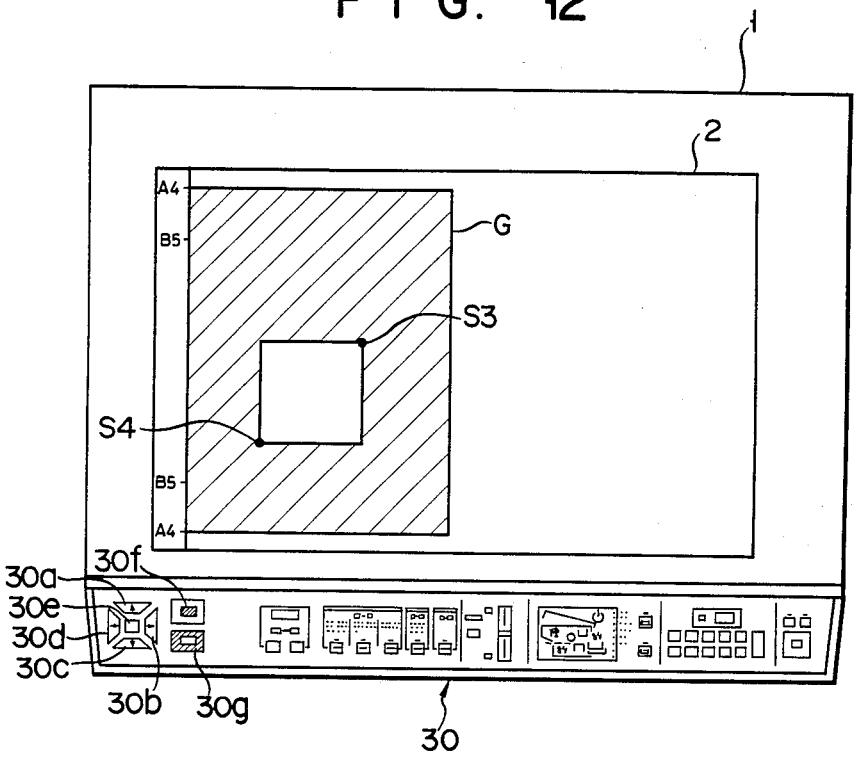

Referring now to FIGS. 10 to 12, there will be described a method for designating the erasure range of the original by means of the spot light source 91.

The spot light source 91 is moved by operating the operation keys 30*a* to 30*d*. When the operation keys 30*b* and 30*d* are depressed, the motor 33 is started, and the first carriage $41_1$ and the spot light source 91 are moved in the scanning direction (indicated by arrow y in FIG. 10). When the operation keys 30*a* and 30*c* are depressed, on the other hand, the motor 95 is started, and the spot light source 91 is moved in a direction (indicated by arrow x in FIG. 10) perpendicular to the scanning direction.

Observing the spot light transmitted through the original G, the operator operates the operation keys 30*a* to 30*d*. When the spot light reaches, for example, a spot S1 on the original G shown in FIG. 11, the operator depresses the position designating key 30*e*. Thereupon, the coordinate position indicated by the spot S1 is stored in the main processor group 71 shown in FIG. 7. Likewise, if the position designating key 30*e* is depressed when a spot S2 on the original G is reached by the spot light, the position of the spot S2 is stored in the main processor group 71. This position of the spot light can be detected by, for example, counting drive pulses delivered from the pulse motors 33 and 95. When the erasure range designating key 30*f* is depressed thereafter, a rectangular region (hatched region) having its two opposite vertexes on the spots S1 and S2 is designated as the erasure range, as shown in FIG. 11.

If the erasure range designating key 30*g* is depressed after designating spots S3 and S4 on the original G, the other region of the original G (i.e. not a square region having its two opposite vertexes on the spots S3 and S4) is designated as the erasure range. Thus, if the erasure range designating key 30*f* or 30*g* is depressed, the main processor group 71 executes calculation in accordance with the positions of the two designated spots, and high- and low-level signals "1" and "0" are stored in those addresses of the memory 120 for the erasure range and the remaining region, respectively.

For example, the memory 120 is formed of a RAM whose capacity in the direction of each column is substantially equal to a value obtained by dividing the moved distance of the spot light source 91 in the x direction by the positional resolution in the x direction, and whose capacity in the direction of each row is substantially equal to a value obtained by dividing the moved distance of the spot light source 91 in the y direction by the positional resolution in the y direction. In the case of FIG. 11, high- and low-level signals are stored in those addresses of the memory 120 for the hatched region and the other region, respectively, based on data supplied from the main processor group 71.

Figure 14:
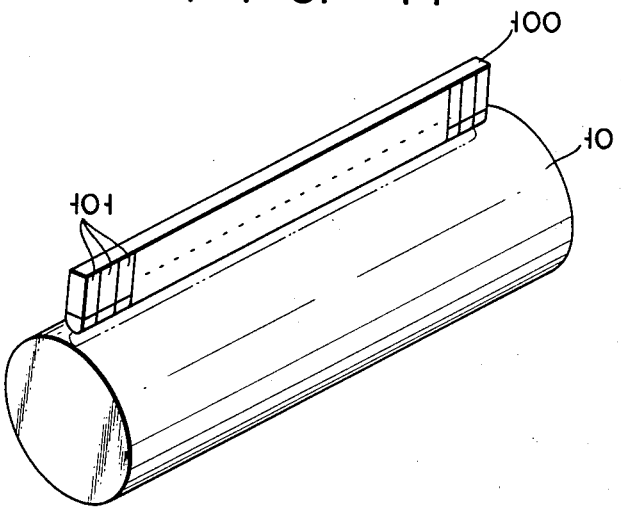
Figure 13:
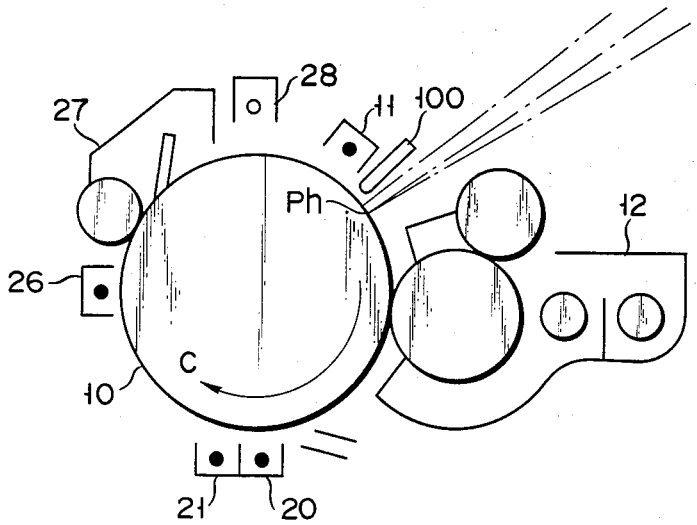
Figure 15:
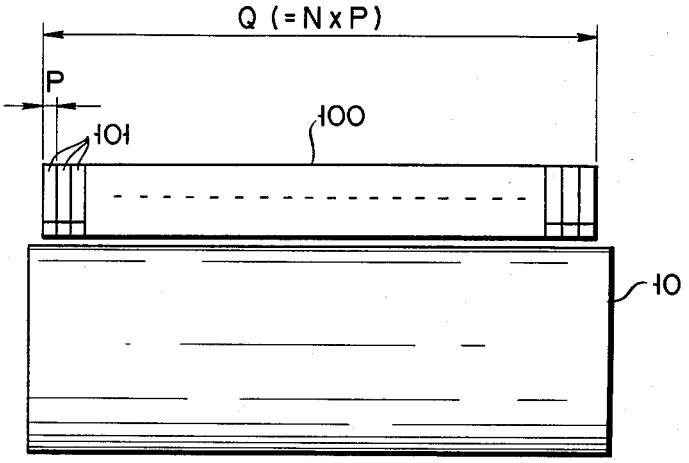
Figure 16A:
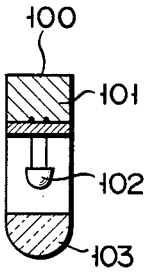
FIG. 16A is a side sectional view of the erasure array.
Figure 16B:
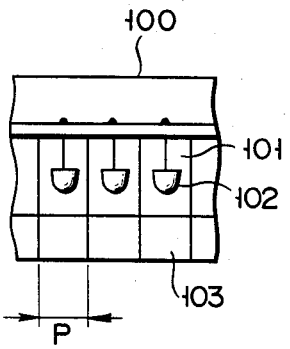
FIG. 16B is a partial front view of the erasure array.

As shown in FIG. 13, on the other hand, the erasure array 100 as the erasing means is disposed close to the photosensitive drum 10, between the charger 11 and an exposure region Ph, for example. As shown in FIGS. 14 and 15, the erasure array 100 includes a plurality of shading cells 101 which are arranged in a direction perpendicular to the rotating direction of the photosensitive drum 10. As shown in FIGS. 16A and 16B, the cells 101 each contains therein a light emitting element 102 formed of, e.g., a light emitting diode. Moreover, a lens 103 for converging light from the light emitting element 102 on the surface of the photosensitive drum 10 is disposed at the opening portion of each cell 101 facing the photosensitive drum 10.

The number of light emitting elements 102 arranged in the erasure array 100 is equivalent to, for example, the column-direction capacity of the memory 120. If the distance between each two adjacent light emitting elements 102 and the number of light emitting elements 102 are P and N, respectively, the overall length Q of the erasure array 100 is $Q=N\times P$.

Figure 17:
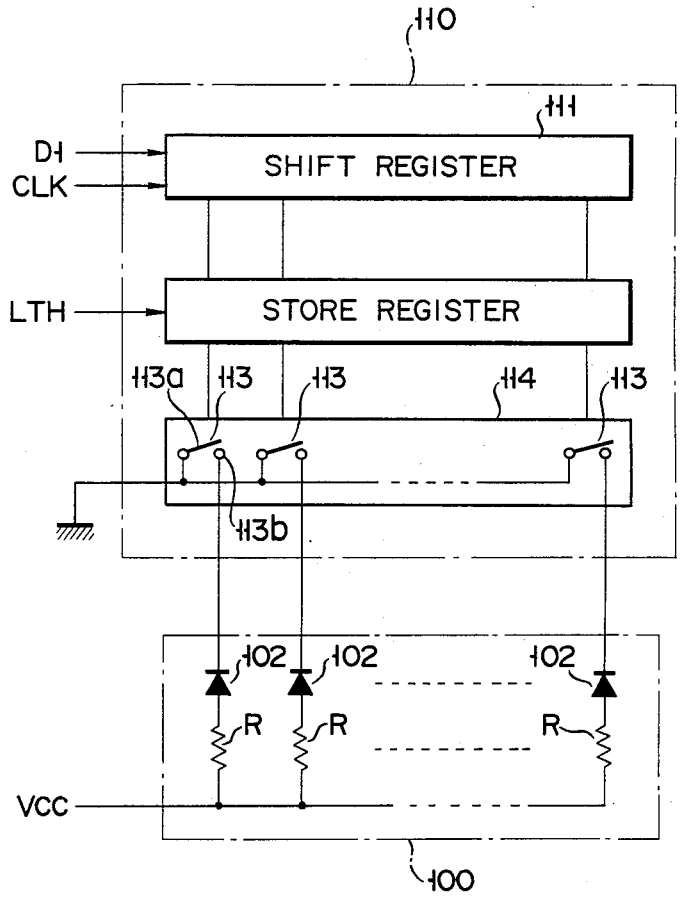

The erasure array 100 is driven by the array drive section 110. As shown in FIG. 17, the array drive section 110 includes a shift register 111 having the same number of bits as that in the column direction of the memory 120, a store register 112 for holding the contents of the shift register 111, and a switch circuit 114 consisting of a plurality of switch elements 113 adapted to be turned on or off in response to output signals from the store register 112. The respective movable contacts 113*a* of the switch elements 113 are grounded, while their fixed contacts 113*b* are connected to the respective cathodes of the light emitting elements 102 constituting the erasure array 100. The anodes of the light emitting elements 102 are connected to a power source $V_{CC}$ through current-limiting resistors R, individually.

When the original cover is laid and the copy key $30_1$ is depressed after the erasure range of the original is designated in the aforesaid manner, the first carriage $41_1$ and the photosensitive drum 10 are actuated, and data D1 for one column are successively read out in the row direction from the memory 120. The read data D1 are transferred to the shift register 111 of the array drive section 110 in response to clock signals CLK. When the charged portion of the surface of the photosensitive drum 10 reaches the erasure array 100 after the data for one column are transferred to the shift register 111, the main processor group 71 delivers a latch signal LTH. In response to the latch signal LTH, the data having so far been stored in the shift register 111 is stored in the store register 112. As mentioned before, the erasure array 100 is disposed between the charger 11 and the exposure region Ph. Therefore, if the angle between the erasure array 100 and the exposure region Ph and the angular velocity of the photosensitive drum 10 are $\theta 1$ and $\omega$, respectively, the output timing of the latch signal LTH is controlled so that data for one row delivered from the memory 120 are supplied to the store register 112 within a time equivalent to $\theta/\omega$.

The individual switch elements 113 of the switch circuit 114 are controlled by the output signals of the store register 112. If the output level of the store register 112 is high, the switch elements 113 are turned on; if low, then off. Thus, the light emitting elements 102 connected to the switch elements 113 are turned on and off when their corresponding switch elements 113 are turned on and off, respectively. Accordingly, those portions of the charged surface of the photosensitive drum 10 which correspond to the glowing light emitting elements 102 are de-electrified. Even though exposed thereafter, the de-electrified portions will never bear any electrostatic latent image thereon. Thus, the erasing of the original image is accomplished. Thereafter, the data in the memory 120 are read out column by column for image erasing.

According to the embodiment described above, unnecessary portions of the original can be erased as specified, so that editing copied images should be facilitated.

Moreover, it is possible to designate the erasure range while observing the spot light on the original table 2, so that operation is easy and there will be no deviation between the designated erasure range and the range actually erased during the copying operation.

Since the spot light source 91 is mounted on the first carriage $41_1$, furthermore, use of space is efficient enough to restrain the apparatus from becoming too bulky.

Figure 18:
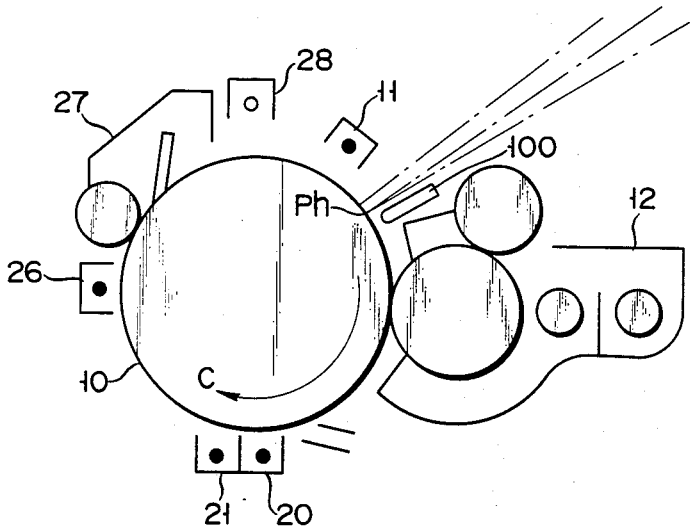

The present invention is not limited to the above embodiment. For example, instead of being disposed between the charger 11 and the exposure region Ph, as shown in FIG. 13, the erasure array 100 may be arranged between the exposure region Ph and the developing unit 12, as shown as a modified example in FIG. 18, so that the formed electrostatic latent image is erased as specified.

Also, the capacity of the memory 120 may be changed as required.

It is to be understood that various changes and modifications may be effected in the present invention by one skilled in the art without departing from the scope or spirit of the invention.

According to the present invention, as described in detail herein, there may be provided an image forming apparatus capable of forming an image of the original while erasing any undesired portions of the image.

What is claimed is:

1. An image forming apparatus comprising:

a photosensitive body holding electric charge on a surface thereof;

charging means for uniformly applying electric charge to the surface of the photosensitive body;

an original table adapted to carry an original thereon;

image exposure means for exposing the surface of the photosensitive body uniformly charged by the charging means to an image of the original on the original table, thereby forming an electric charge pattern responsive to the original image on the surface of the photosensitive body;

developing means for developing the electric charge pattern on the surface of the photosensitive body formed by the image exposure means;

indicating means for indicating a specific range of the original on the original table, said indicating means including: (a) light emitting means for applying a spot light to the original on the original table from under the same, said light emitting means including a light emitting element, disposed under the original table so as to be movable along the same, emitting light of sufficient brightness to be transmitted through the original on the original table, and (b) moving means for moving the light emitting element along the original table and detecting means for detecting the position of the light emitting element moved by the moving means, and erasing means for erasing the electric charge on the surface of the photosensitive body in response to the specific range of the original indicated by the indicating means.

2. The image forming apparatus according to claim 1, wherein said moving means includes first moving means for moving the light emitting element in a first direction along an original scanning direction and second moving means for moving the light emitting element in a second direction perpendicular to the first direction.

3. The image forming apparatus according to claim 2, wherein said indicating means defines two spots for the light emitting element in accordance with the result of detection by the detecting means so that the specific range is indicated by a rectangle a diagonal of which is coincident with a segment connecting the two spots.

4. The image forming apparatus according to claim 3, wherein said rectangle has two sides parallel to the first direction and its other two sides parallel to the second direction.

5. The image forming apparatus according to claim 1, wherein said erasing means includes second light emitting means, opposed to the surface of the photosensitive body, for exposing that portion of the surface of the photosensitive body which corresponds to a portion indicated by the specific range indicated by the indicating means.

6. The image forming apparatus according to claim 5, wherein said photosensitive body is movable in one direction, and said second light emitting means includes a plurality of second light emitting elements arranged in the other direction perpendicular to the one direction.

7. The image forming apparatus according to claim 6, wherein said photosensitive body includes a rotatable photosensitive drum, and said second light emitting elements are arranged in the axial direction of the photosensitive drum.

8. The image forming apparatus according to claim 5, wherein said second light emitting elements are arranged between the charging means and the image exposure means.

9. The image forming apparatus according to claim 5, wherein said second light emitting elements are arranged between the image exposure means and the developing means.

* * * * *